US007270187B2

(12) United States Patent
Shulyatikov et al.

(10) Patent No.: US 7,270,187 B2
(45) Date of Patent: Sep. 18, 2007

(54) FLYING VALVE AND WELL PRODUCTION METHOD

(76) Inventors: Vladimir Igorevich Shulyatikov, ul. B. Cherkizovskaya, 6-7-21, Moscow (RU) 107061; Igor Vladimirovich Shulyatikov, ul. B. Cherkizovskaya, 6-7-21, Moscow (RU) 107061; Alexei Vladimirovich Shulyatikov, ul. Borisovskie prudl, 15-2-31, Moscow (RU) 115408; Svetlana Alexandrovna Sidorova, ul. Elevatornaya, 6-2-103, Moscow (RU) 115404; Leonty Petrovich Malovichko, ul. Podlesnaya, 2-33, Moscow (RU) 141080

( * ) Notice: Subject to any disclaimer, the term of this patent is extended or adjusted under 35 U.S.C. 154(b) by 193 days.

(21) Appl. No.: 10/512,652

(22) PCT Filed: Apr. 29, 2003

(86) PCT No.: PCT/RU03/00203

§ 371 (c)(1),
(2), (4) Date: Oct. 21, 2004

(87) PCT Pub. No.: WO03/093636

PCT Pub. Date: Nov. 13, 2003

(65) Prior Publication Data

US 2005/0161223 A1 Jul. 28, 2005

(30) Foreign Application Priority Data

Apr. 30, 2002 (RU) ..... 2002111440

(51) Int. Cl.
*E21B 43/00* (2006.01)

(52) U.S. Cl. ..... 166/369; 166/105; 166/111

(58) Field of Classification Search ..... 166/369, 166/105, 111; 417/554
See application file for complete search history.

(56) References Cited

U.S. PATENT DOCUMENTS

| | | | | |
|---|---|---|---|---|
| 3,020,964 A | * | 2/1962 | Williams et al. | 175/237 |
| 3,077,204 A | * | 2/1963 | Bennett et al. | 137/843 |
| 5,092,495 A | * | 3/1992 | Andre | 222/341 |
| 6,148,923 A | | 11/2000 | Casey | |

FOREIGN PATENT DOCUMENTS

| | | | |
|---|---|---|---|
| RU | 2070278 C1 | | 12/1996 |
| SU | 1020568 A | | 5/1983 |
| SU | 1174595 | * | 8/1985 |
| SU | 1236164 A1 | | 6/1986 |
| SU | 1359483 A1 | | 12/1987 |

* cited by examiner

*Primary Examiner*—William P Neuder
(74) *Attorney, Agent, or Firm*—Volpe and Koenig, P.C.

(57) ABSTRACT

The invention relates to oil and gas production and can be used for lifting liquid from wells by gas energy. A flying valve includes a tubular body, a detachable element in the form of a body of rotation, and stoppers limiting the penetration of the element into the body. The detachable element or the tubular body or both are made of an oil-resistant material. The inventive method consists in periodically dropping the flying valve under the liquid level in the well to a lower bumper sub and in subsequently lifting the flying valve together with a liquid column which is disposed thereabove. The body and the detachable element are dropped separately, i.e., the detachable element of the flying valve is dropped before the body or vice versa.

14 Claims, 11 Drawing Sheets

FLYING VALVE AND WELL PRODUCTION METHOD

FIELD OF INVENTION

This invention relates to the oil and gas production industry and can be used for lifting liquids from wells using gas energy, in particular, for lifting water from wells or shafts using air drawn or injected from the surface. In addition, the claimed method allows cutting wax from the pipes surface in case of lifting oil from wells.

BACKGROUND

The known constructions of flying valves for plunger lift contain a tubular body and a detachable element, as a rule, in the form of a steel ball (inventor's certificates SU 63138, SU 171351, SU 596710, SU 791939, SU 802525, and U.S. Pat. No. 2,074,012, U.S. Pat. No. 3,090,316, U.S. Pat. No. 6,209,637). All above devices satisfactorily work in small-diameter wells when diameter and hence the mass of the body and detachable element of flying valves are relatively small. With the increase of well diameters and the mass of steel balls the use of flying valves becomes seriously complicated or even impossible due to jump of shock loads resulting in deformation of tubes in wells, damage of equipment and even destruction of steel balls.

SUMMARY

The claimed invention allows to remove the above mentioned drawbacks and use flying valves for lifting liquids from wells of any diameter.

According to the invention the flying valve contains a tubular body, entering it completely or partially a detachable element in the form of a figure of revolution with a device restricting its entering the body, with the detachable element or tubular body being made from oil-resistant (in case of water-water-resistant) elastic material, in particular, from rubber of various brands.

The detachable element can be of a spherical, teardrop-shaped or ellipsoidal form and in addition can be equipped with three or more flat stabilizers evenly distributed in the periphery. The stabilizers butts facing the body can serve as devices restricting the detachable element entering the body of the flying valve.

Stoppers can be made not on the detachable element but on the body of the flying valve, for instance as projections located on the inner wall of the body.

In the wall of the body in the part of its height mismatching stoppers drain ports can be made, and/or the wall of the body at the same level can be made in the form of silphon.

In addition, on the outer surface of the body at the level mismatching the drain ports annular grooves can be made complete with ring straps or without them.

In another embodiment on the outer surface of the body either straps with longitudinal, inclined or spiral grooves throughout perimeter can be installed or grooves can be made directly on the outer surface of the body. On the inner surface of the body circular inserts can be installed.

On the outer rims of the detachable element's stabilizers rotating contacts can be installed. In another embodiment, planes of stabilizers can be inclined with regard to the axis of the detachable element, and their outer rims are equipped with scrapers.

Elastic material of the detachable element may have inclusions and/or patches of a more compact material which allows regulation of its weight (average density) keeping the same dimensions.

The well production method with use of a flying valve according to invention includes periodical running of the flying valve under the liquid level in the well till the lower shock absorber and the subsequent its lifting together with the column of liquid above the flying valve.

The runnings of the body of the flying valve and of the detachable element of the valve are carried out separately, the detachable element of the flying valve can be run first and then its body, or vice versa.

In the first case during the lifting the following proportion should be observed:

$$P_{se}/S_{ds}<P_b/S_{sab}$$

Where $P_{se}$—weight of detachable element, $S_{ds}$—area of diametral section of detachable element, $P_b$—weight of body, $S_{sab}$—sectional area of the flying valve body.

In the second case the sign between the right and left sides of equation is changed for the opposite:

$$P_{se}/S_{ds}<P_b/S_{sab}$$

If the detachable element of the flying valve is equipped with stabilizers its lifting and lowering is carried out with stabilizers being positioned downward.

In a pulled-out position the body and the detachable element of the flying valve can be divided by the rod installed in the upper part of the well along its axis. The separation of the body and the detachable element of the flying valve can be executed by short-time closing of valve on the pipeline exporting product from the well.

In case of insufficient gas pressure in the well or shaft, a decreased pressure is maintained above the lifted liquid (continuously or periodically).

The cycles of lifting and lowering of the flying valve can be monitored by the change of temperature in the wellhead taking place with appearance in the wellhead of a next portion of lifted liquid.

DETAILED DESCRIPTION OF THE PREFERRED EMBODIMENTS

Figure 1:
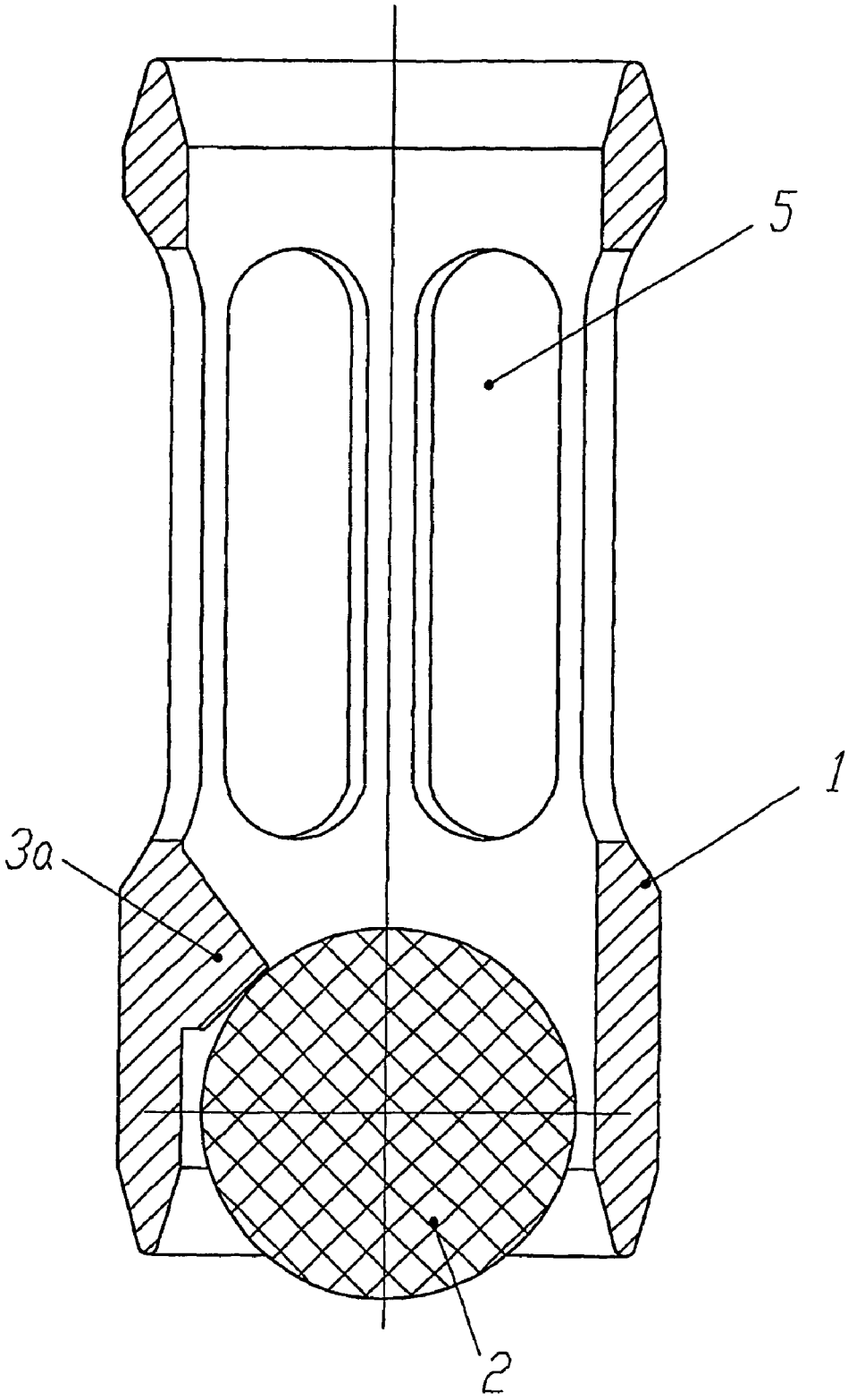
FIG. 1 shows one of designs of the flying valve with detachable element in the form of a ball, according to the invention.

Reference number 1 in the drawings corresponds to the tubular body of the flying valve; number 2—the detachable element in the form of a figure of revolution entering body 1; 3—device restricting detachable element's 2 entering body 1, various embodiments of these units have additional lettering (2*a*, 3*b* etc.).

The detachable element of the flying valve can be of a spherical, teardrop-shaped or ellipsoidal form and in addition can be equipped with three or more flat stabilizers 4 evenly distributed in the periphery. The stabilizers 4 butts facing the body 1 can serve as devices 3*b* restricting the detachable element 2 entering the body 1 of the flying valve.

Stoppers 3 can be made not on the detachable element 2 but on the body 1 of the flying valve, for instance as projections 3*a* located on the inner wall of the body 1.

In any case, the contact of detachable element 2 with tubular body 1 of the flying valve takes place not throughout the entire perimeter (not throughout the circumference line) but at its separate sections. And between detachable element 2 and tubular body 1 there is always a small clearance with a certain part of gas passing through it. This gas bubbles through liquid being in the body which prevents the separation of element 2 from body 1 during lifting of the flying valve in the event of a change of the lifting speed.

Figure 2:
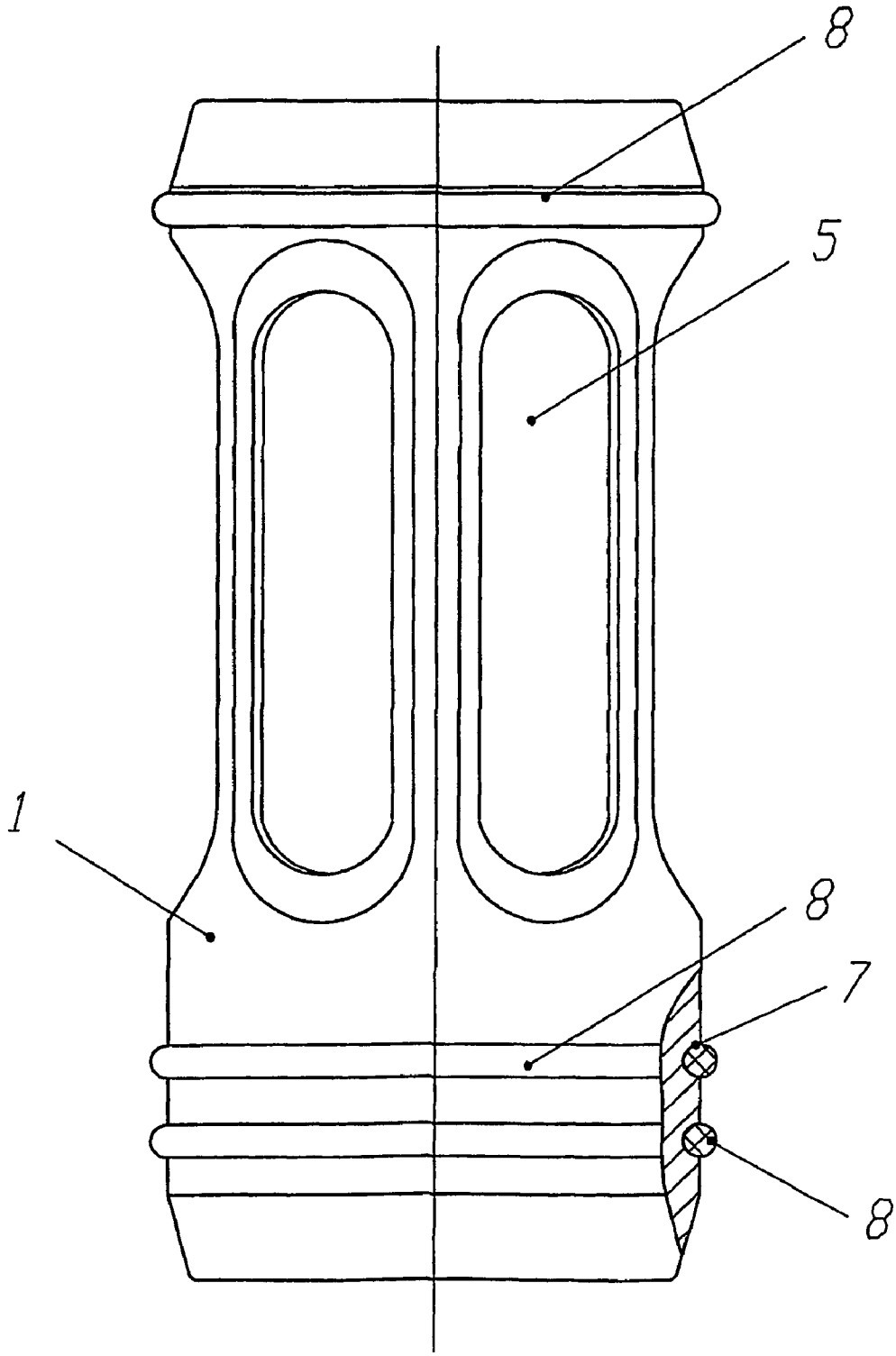
FIG. 2 shows the flying valve with drain ports in the tubular body, at the outer surface of which there are annular grooves with ring straps in them, according to the invention.
Figure 5:
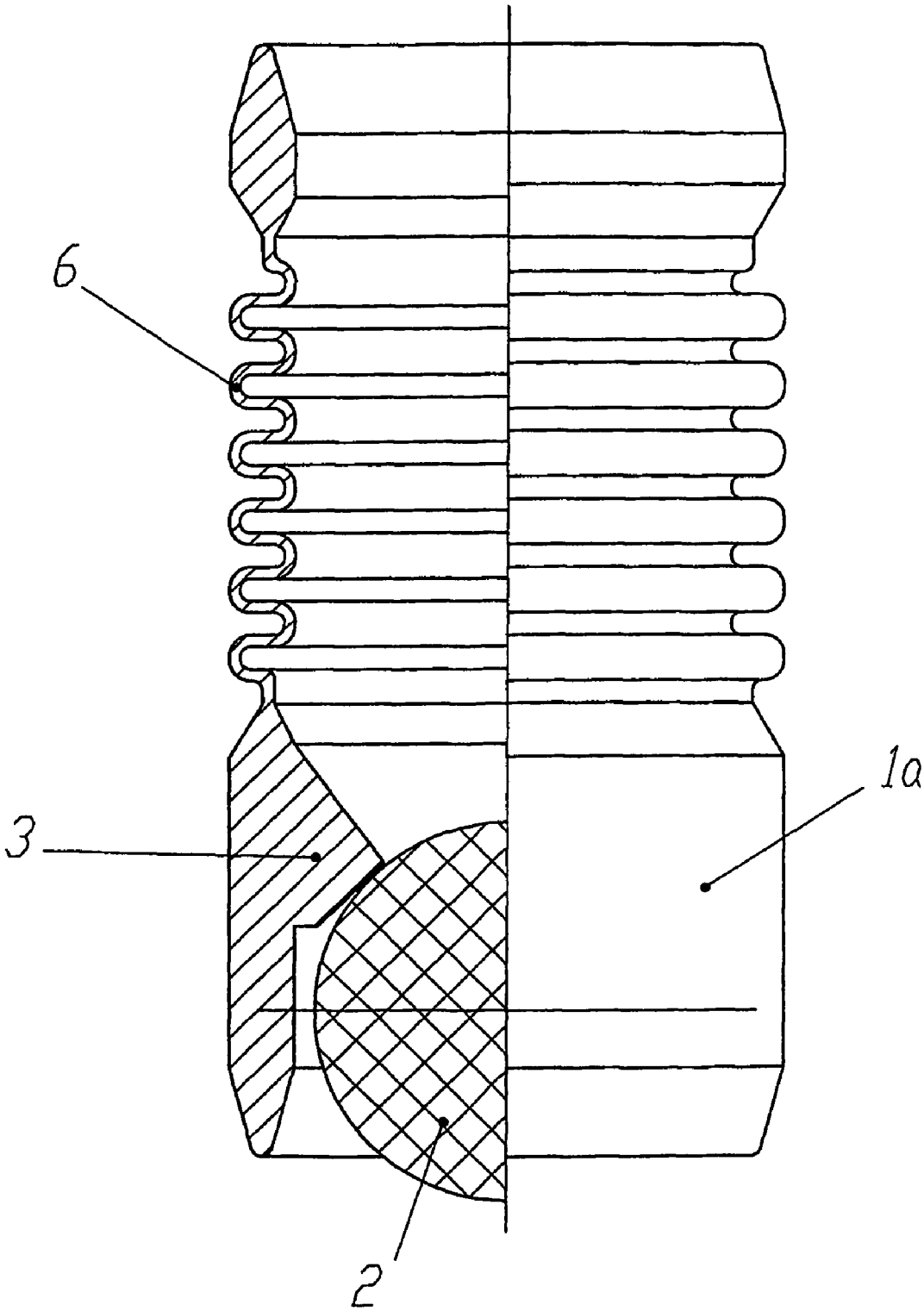
FIG. 5 shows the flying valve with the valve body made as a silphon, according to the invention.
Figure 6:
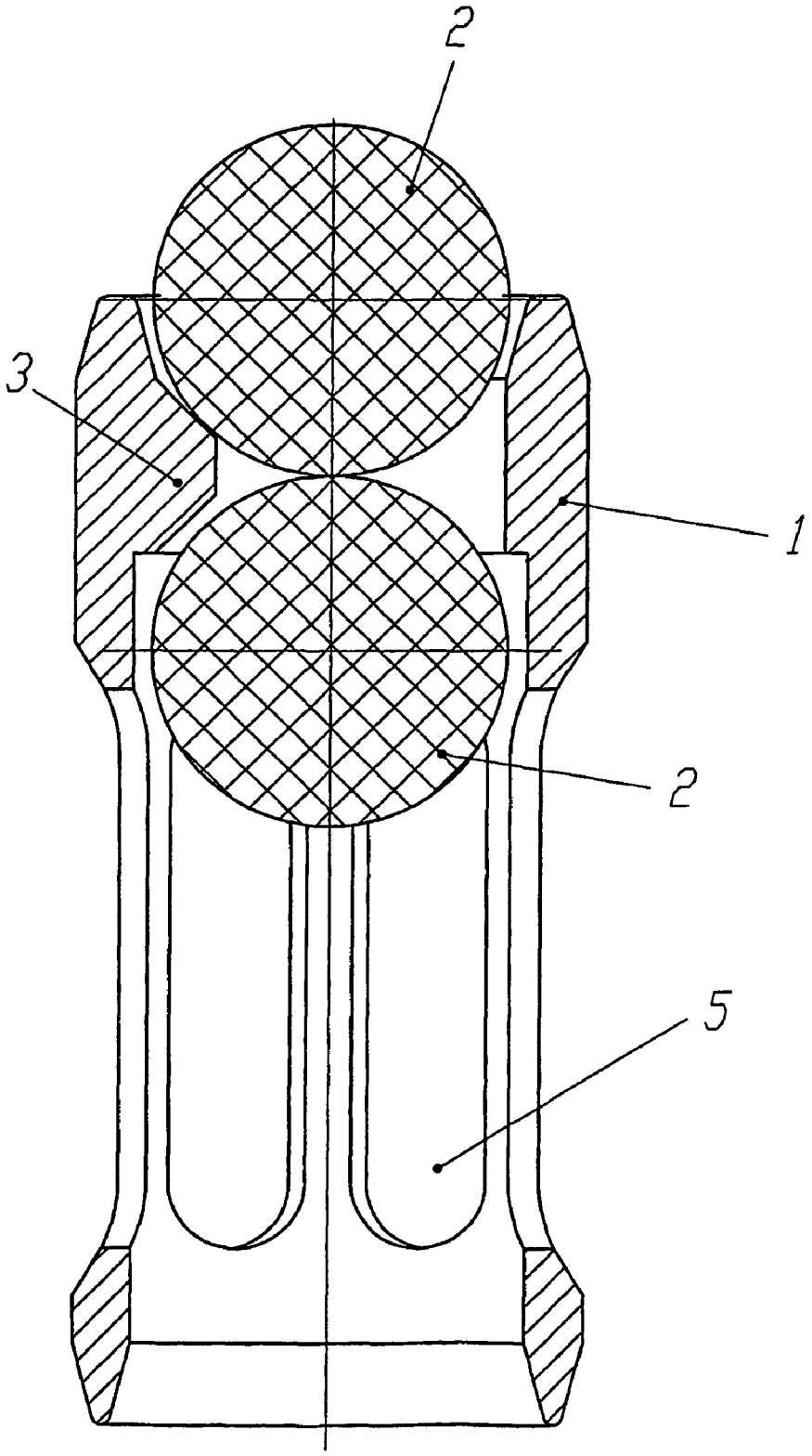
FIG. 6 shows two possible variants of the tubular body and detachable element positional relationship, according to the invention.

In the wall of body 1 in the part of its height mismatching stoppers 3*a* drain ports 5 (FIG. 1) can be made, or the wall of body 1 at the same level can be made in the form of silphon 6 (FIG. 5). In addition, on the outer surface of body 1 at the level mismatching drain ports 5 annular grooves 7 can be made complete with ring straps 8 (FIG. 2) or without them.

Drain ports 5 allow to equalize the pressure on the detachable element and exclude draining of liquid into the clearance between body 1 and the tube during the lifting of the flying valve.

Figure 11:
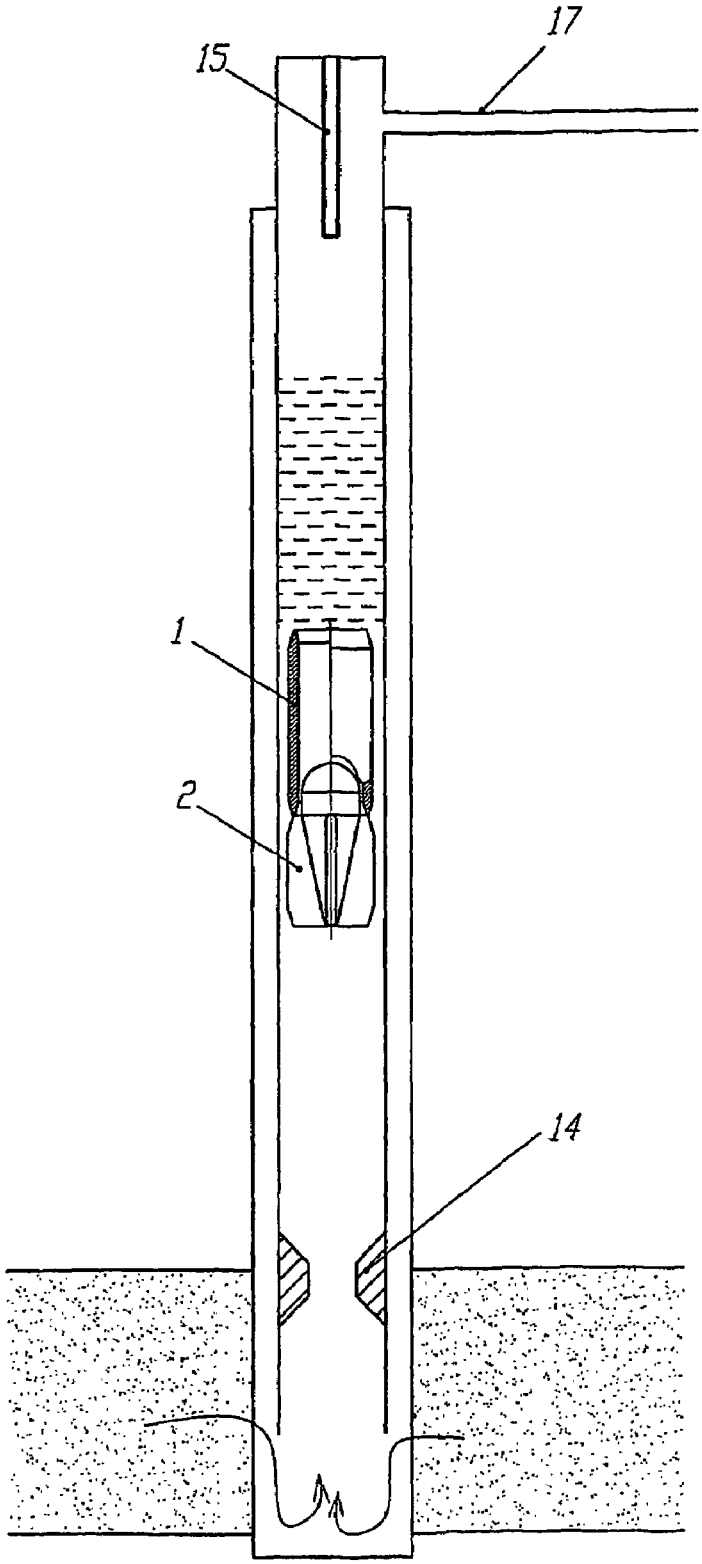
FIG. 11 shows the lifting of a column of liquid from the well (or from the shaft) by means of the flying valve, according to the invention.

In another embodiment on the outer surface of body 1 straps 9 with longitudinal grooves 10 throughout perimeter can be installed, and on the inner surface of body 1 circular inserts 11 can be installed (FIG. 11).

Ring straps 8 from the outside of body 1 or circular inserts 11 on its inner surface enable regulating the tubing flow area in wells as well as the flow area of the flying valve itself.

Longitudinal grooves 10 made on straps 9 enable stabilize the process of the flying valve lifting, diminishing the possibility of its radial runout and beating on the tubing walls.

Figure 7:
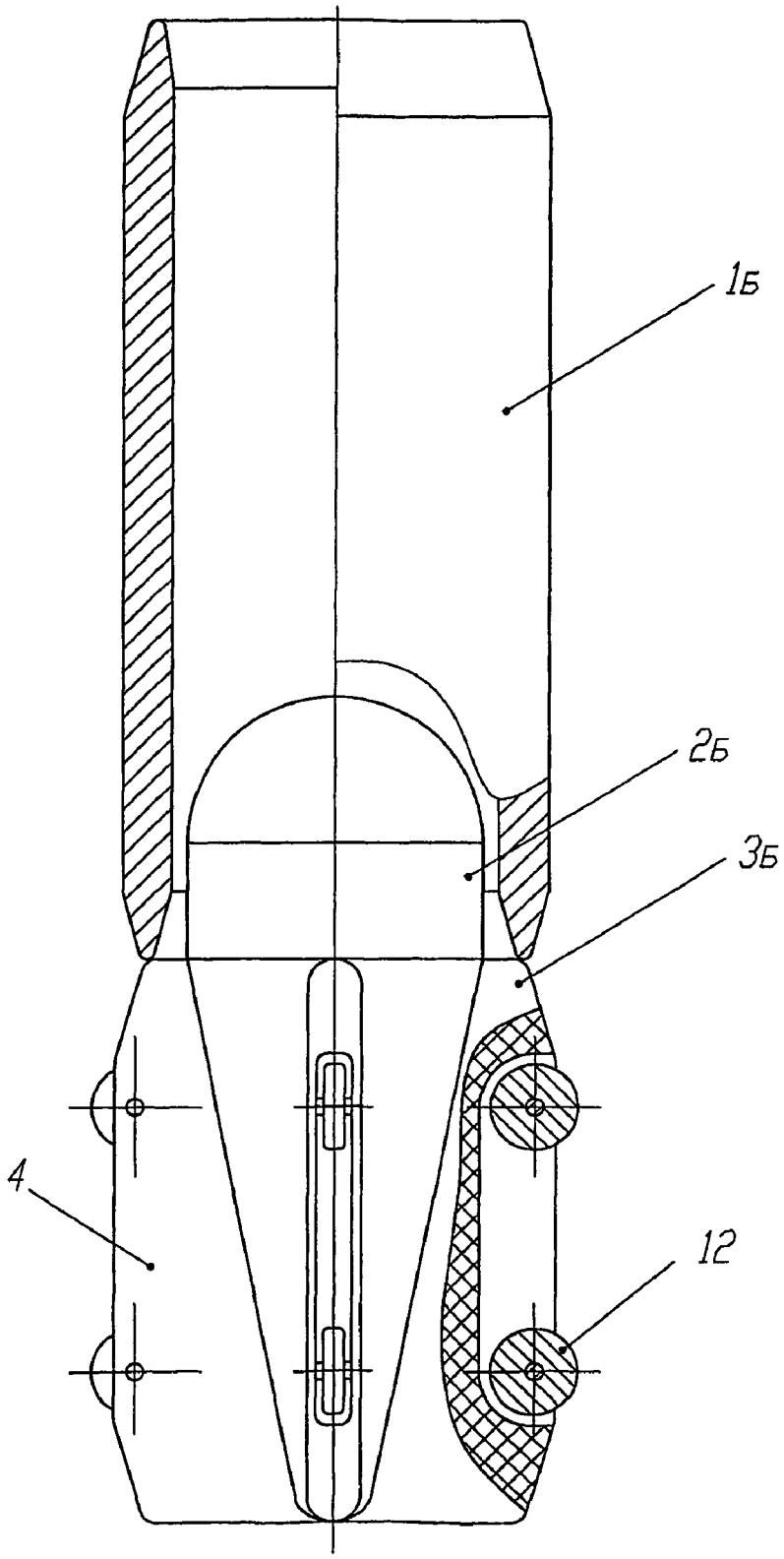
FIG. 7 shows the flying valve with the detachable element complete with four stabilizers, according to the invention.
Figure 8:
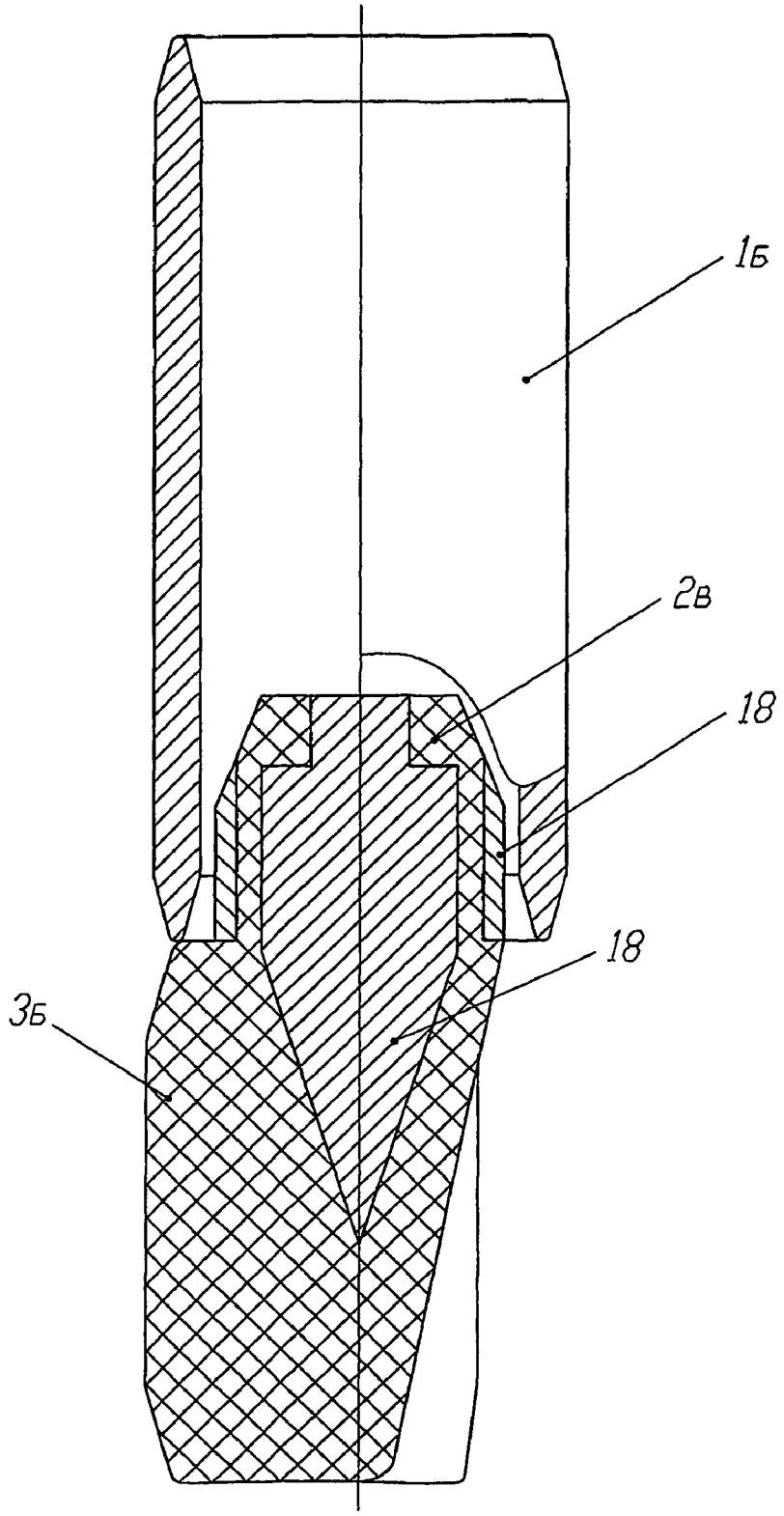
FIG. 8 shows the flying valve with the detachable element complete with three stabilizers and ballast made of a more compact material, according to the invention.
Figure 9:
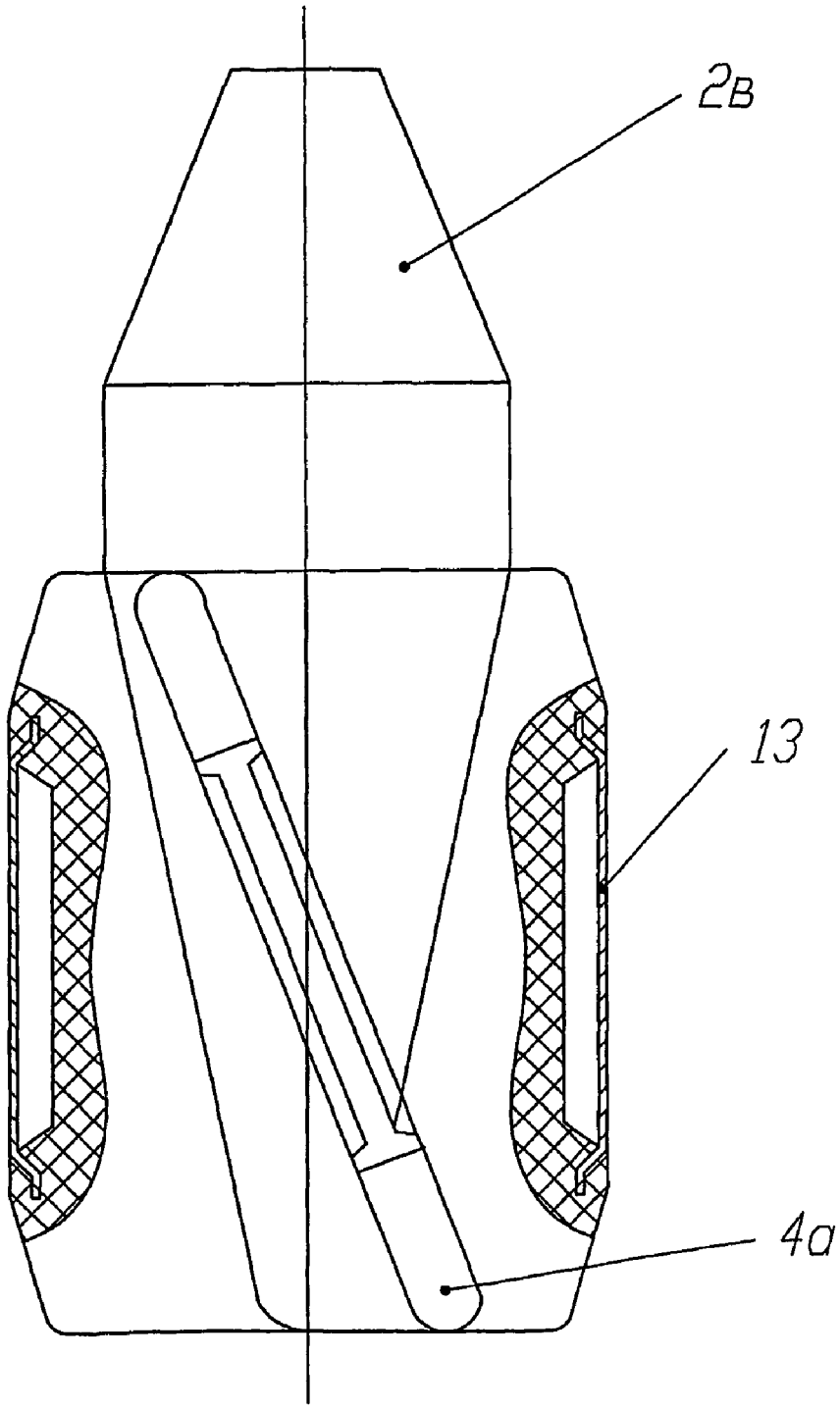
FIG. 9 shows the detachable element with inclined stabilizers whose outer rims are equipped with scrapers.

On the outer rims of stabilizers 4 of detachable element 2 rotating contacts 12 can be installed (FIG. 7) which contributes to reducing friction of detachable element 2 on the pipes wall in the well. In another embodiment, stabilizers planes 4*a* can be inclined with regard to the axis of detachable element 2, and their outer rims provided with scrapers 13 (FIG. 9). The incline of stabilizers planes 4*a* imparts to detachable element 2 rotation about its axis and help keep the preset position during the lowering (without tumbling). Scrapers 13 provide additional technical result in oil wells operation. They can be used for removing wax accumulations at inner walls of pipes in wells.

Elastic material of the detachable element may have inclusions; inserts or edging of a more compact material which allows regulation of its weight (average density) keeping the same dimensions. The edging, in addition to weight regulation, helps retain the shape of the detachable element preventing the swelling of rubber under the well production impact.

Figure 10:
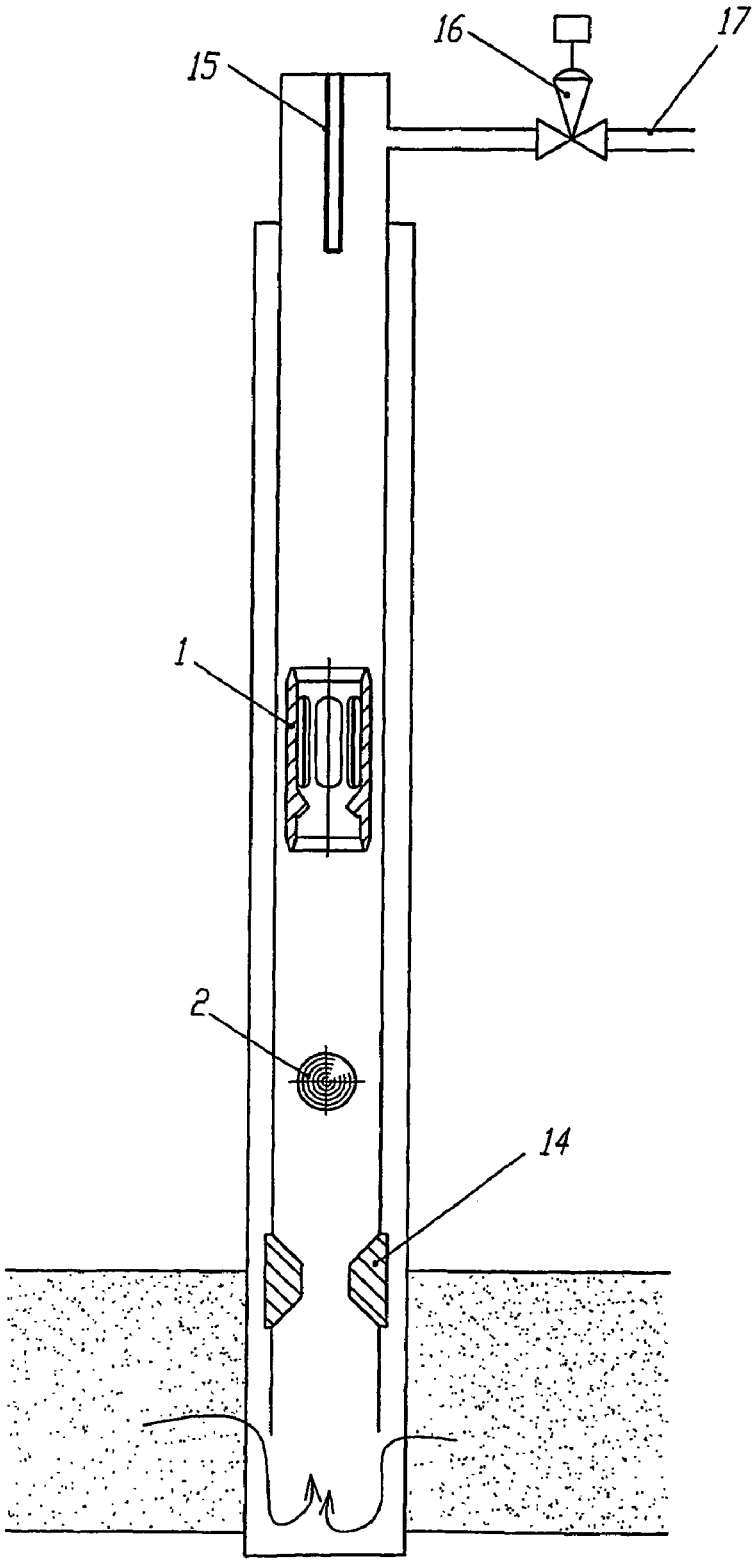
FIG. 10 schematically shows the lowering of the flying valve into a well, according to the invention.

The well production method with use of a flying valve includes periodical running of the flying valve under the liquid level in the well till the lower shock absorber 14 and the subsequent its lifting together with the column of liquid above the flying valve (FIGS. 10, 11).

The runs of the body of the flying valve and of the detachable element of the valve are carried out separately, the detachable element of the flying valve can be run first and then its body, or vice versa. A body in the form of silphon 6 provides additional shock-absorption of impact loads when parts of the flying valve contact with the lower shock absorber or between themselves.

Under the gravity force the detachable element of the flying valve falls free in the well overcoming some resistance of gas and submersions in liquid in the lower part of the well. The falling or running is stopped when the detachable element reaches a lower shock absorber 14 (FIG. 10). The body 1 of the flying valve falls after the detachable element 2 and also stops at a level of the lower shock absorber 14 resting upon the stoppers 3 of entrance of the detachable element 2 into the body 1. Elastic material of the detachable element 2 prevents deformation and damage of the lower shock absorber 14, well pipes and the detachable element 2 itself.

If the detachable element 2 of the flying valve is provided with stabilizers, then it is preferable to trip a detachable element with stabilizers being positioned downward.

After joining the body and detachable element of the flying valve close the most part of a pipe flow area and gas having no possibility to bubble through a liquid layer begins, at the expense of pressure, push out the flying valve together with a liquid column located above it upward to the well head (FIG. 11).

When lifted, the body and the detachable element of the flying valve can be separated (if the detachable element is below) with the help of a rod 15 placed in the upper part of the well along its axis. In this case the rod 15 freely passes through a hole of the tubular body 1, tests on the detachable element 2, stops it and separate from the tubular body 1 that continues its moving upward. After that the parts of the flying object separately fall into the well beginning a next cycle of liquid lifting from the well.

The body and the detachable element of the flying valve can be separated by a brief closing of a valve 16 on a pipeline 17 that exports gas from the well. In this case gas pressure above and below the flying valve is quickly leveled and the flying valve parts again separately falls down.

When a well is operated with a flying valve with a detachable elements being below, the following relationship preventing separation of the flying valve parts during their lifting with liquid column must be stand:

$$Pse/Sds < Pb/Sbs$$

Where Pse is the weight of the detachable element, Sds is the area of diametral section of the detachable element, Pb is the weight of the body and Sbs is the sectional area of the body of the flying valve.

When the detachable element is above and the tubular body is below, the character between the right and left sides of the equation changes into opposite:

$$Pse/Sds > Pb/Sbs$$

Figure 3:
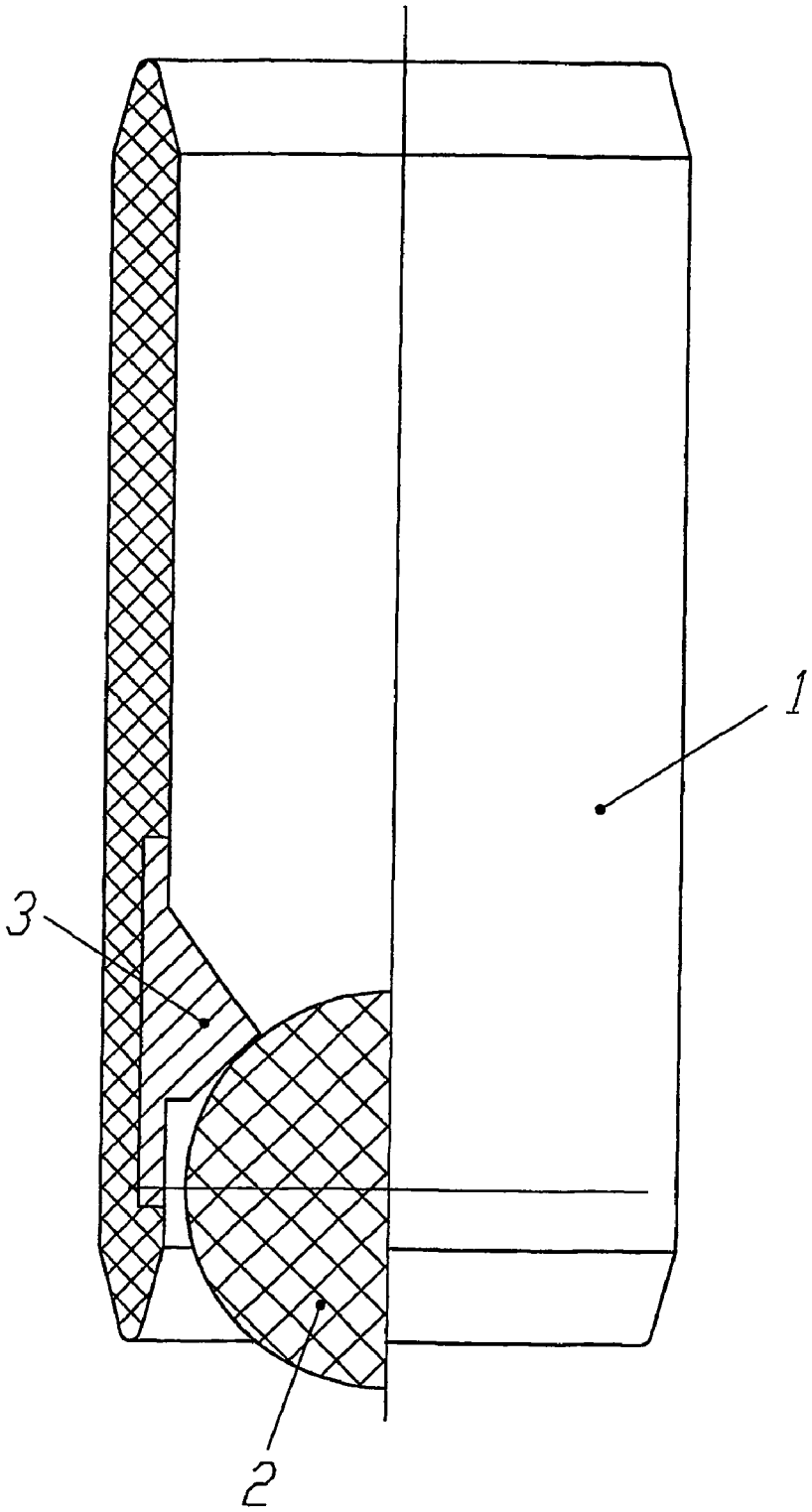
FIG. 3 shows the flying valve with the restricting device as a projection on the inner wall of the body with the projection being made of a material different from that of the body, according to the invention.
Figure 4:
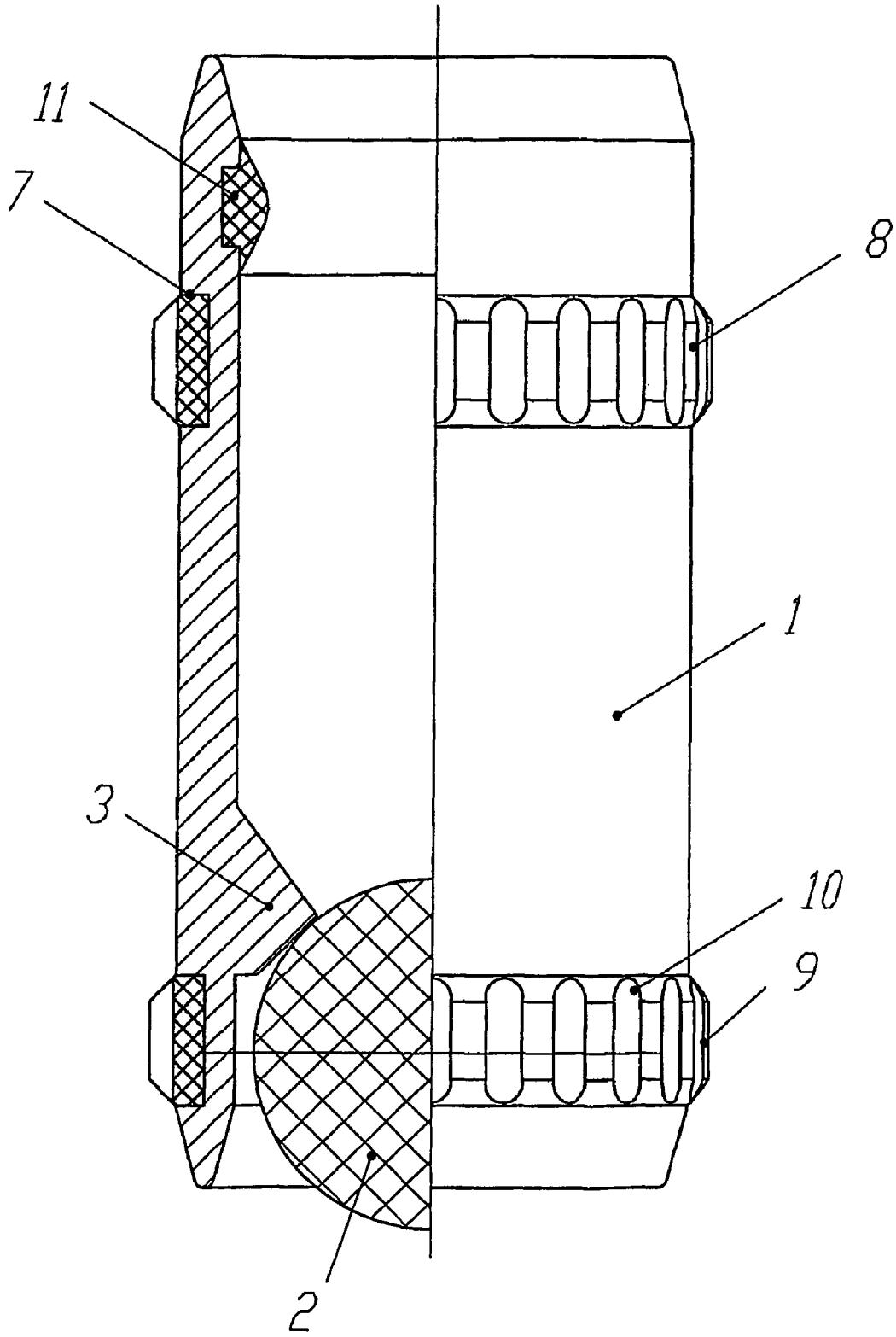
FIG. 4 shows the flying valve with straps on the outer surface of the body with longitudinal grooves throughout perimeter and with the restricting device being made as a projection on the inner wall of the body, according to the invention.

To keep these relationships, under limited possibilities to change sectional areas, material and, accordingly, the weight of body and detachable element of the flying valve are selected. In that, elastic material of the detachable element may contain fillers, as well as inclusions, edgings or inserts 18 made of more dense material. The tubular body can be of composite type (for example, the body itself is made of rubber while stoppers are made of metal) (FIG. 3).

Cycles of lifting and lowering of the flying valve can be controlled by a change in well head temperature that takes place when a lifted column of liquid reaches the well head.

We claim:

1. A flying valve comprising a tubular body, detachable element in the form of a body of rotation entering said tubular body and stoppers limiting the penetration of said element into the body with said flying valve, wherein the detachable element and/or the tubular body are made of an oil-resistant elastic material, wherein said stoppers are made in the form of shoulder seats located on internal surface of the body, and drain ports are made in the body wall and located on a part of its height at a level not coinciding with said stoppers.

2. A flying valve as set forth in claim 1, wherein said detachable element has spherical, tear-shaped or ellipsoid form.

3. A flying valve as set forth in claim 1, wherein said tubular body wall is made on a part of its height at a level not coinciding with said stoppers as a silphon.

4. A flying valve as set forth in claim 1, wherein annular grooves, in which ring straps are placed in, are made on the external surface of said body at a level not coinciding with said drain ports.

5. A flying valve as set forth in claim 1, wherein straps with longitudinal grooves are placed on the external surface of said body.

6. A flying valve as set forth in claim 1, wherein circular inserts are placed on the internal surface of said body.

7. A detachable element of a flying valve comprising a body of rotation, wherein said detachable element is made of oil and lubricant-resistant elastic material, wherein said detachable element is provided at least with three flat stabilizers having end faces which face a body of said flying valve and serve as stoppers for entering said detachable element into the body of said flying valve and end faces of said stabilizers are provided with rotating contacts.

8. A detachable element as set forth in claim 7, wherein said detachable element is provided at least with three flat stabilizers having end faces which face a body of said flying valve and serve as stoppers for entering said detachable element into the body of said flying valve and plains of said stabilizers are inclined to an axis of said detachable element.

9. A detachable element as set forth in claim 7, wherein said detachable element is provided at least with three flat stabilizers having end faces which face a body of said flying valve and serve as stoppers for entering said detachable element into the body of said flying valve and external edges of said stabilizers are provided with scrapers.

10. A method of well operation with the help of a flying valve comprising a tubular body, a detachable element and devices restricting the entry of said detachable element into said body and comprising a periodical run of said flying valve under a liquid level in a well up to a lower shock absorber followed by its lifting together with a liquid column being above said flying object with said body of said flying valve and said detachable element running separately wherein said detachable element and/or said body of said flying valve are made of elastic material resistant to well products exposure, wherein the run of said detachable element of said flying valve is followed by the run of its body with using said flying valve for which:

$$Pse/Sds < Pb/Sbs$$

where Pse is the weight of the detachable element, Sds is the area of diametral section of the detachable element, Pb is the weight of the body and Sbs is the sectional area of the body of the flying valve, and said detachable element of said flying valve is provided with three or four flat stabilizers with said stabilizers being downward when tripping said detachable element.

11. A method as set forth in claim 10 wherein the run of said body of said flying valve is followed by the run of its detachable element with using said flying valve for which:

$$Pse/Sds > Pb/Sbs.$$

12. A method as set forth in claim 10 wherein said body and said detachable element of said flying valve are separated, when lifted, by closing a valve on a pipeline that exports gas from said well.

13. A method as set forth in claim 10 wherein a decreased pressure in said well is maintained when liquid is lifted with the help of said flying valve.

14. A method as set forth in claim 10 wherein cycles of said flying valve tripping are controlled by a change in wellhead temperature.

* * * * *